US012409970B2

(12) United States Patent
Learn

(10) Patent No.: US 12,409,970 B2
(45) **Date of Patent: *Sep. 9, 2025**

(54) CONTAINER WITH INTEGRAL CONDIMENT POCKET

(71) Applicant: PACTIV LLC, Lake Forest, IL (US)

(72) Inventor: Angela E. Learn, Gilbertsville, PA (US)

(73) Assignee: PACTIV LLC, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/648,878

(22) Filed: Apr. 29, 2024

(65) Prior Publication Data

US 2024/0359860 A1 Oct. 31, 2024

Related U.S. Application Data

(63) Continuation of application No. 17/860,245, filed on Jul. 8, 2022, now Pat. No. 11,999,538.

(60) Provisional application No. 63/219,634, filed on Jul. 8, 2021.

(51) Int. Cl.

| | |
|---|---|
| ***B65D 5/44*** | (2006.01) |
| ***B65D 5/02*** | (2006.01) |
| ***B65D 5/18*** | (2006.01) |
| ***B65D 5/42*** | (2006.01) |

(52) U.S. Cl.

CPC ..... *B65D 5/44* (2013.01); *B65D 5/0209* (2013.01); *B65D 5/18* (2013.01); *B65D 5/4279* (2013.01)

(58) Field of Classification Search

CPC ..... B65D 5/44; B65D 5/0209; B65D 5/18; B65D 5/4279; B65D 5/48002; B65D 81/3205; B65D 5/6685; B65D 31/12; B65D 5/443; A47G 21/001; A45F 2003/205

USPC ..... 229/400, 904, 906, 120.18, 120.13, 229/120.22, 72, 120.08, 120.02, 902, 106; 206/541, 561; 220/23.8, 23.86, 505, 62; 383/38; 426/120

See application file for complete search history.

(56) References Cited

U.S. PATENT DOCUMENTS

| | | | |
|---|---|---|---|
| 4,126,261 | A | 11/1978 | Cook |
| 4,955,528 | A | 9/1990 | Schluckebier |
| 5,540,333 | A | 7/1996 | Gonzalez et al. |
| 5,626,283 | A | 5/1997 | Mellon |

(Continued)

OTHER PUBLICATIONS

U.S. Appl. No. 17/860,245 (U.S. Pat. No. 11,999,538), filed Jul. 8, 2022 (Jun. 4, 2024).

(Continued)

*Primary Examiner* — Christopher R Demeree
(74) *Attorney, Agent, or Firm* — Baker Botts L.L.P.

(57) ABSTRACT

Unitary blank for forming a container includes a base panel, a back body panel, a front body panel, a first side panel, a second side panel, and a pocket portion. The pocket portion includes a support panel, a pocket flap, a first side tab, and a second side tab. The first and second side panels are configured to be joined to the back body panel such that the front and back body panels and the first and second side panels define a container. A support panel of the pocket portion is configured to be separated from the front body panel along a front upper edge and joined to the back body panel such that the pocket portion and the back body panel define a pocket therebetween. A container and a method for forming a container from a unitary blank are also provided.

18 Claims, 4 Drawing Sheets

(56) References Cited

U.S. PATENT DOCUMENTS

| | | | | |
|---|---|---|---|---|
| 5,720,429 | A | 2/1998 | Cordle | |
| 5,875,957 | A | 3/1999 | Yocum | |
| 6,050,482 | A | 4/2000 | Cai | |
| 6,053,403 | A | 4/2000 | Cai | |
| 6,102,208 | A * | 8/2000 | Huang | B65D 81/3205 206/541 |
| 6,119,930 | A * | 9/2000 | Lunstra | B65D 5/48002 229/116 |
| 6,182,890 | B1 * | 2/2001 | Sattler | B65D 5/3685 229/104 |
| 6,216,946 | B1 | 4/2001 | Cai | |
| 6,349,874 | B1 * | 2/2002 | Hill | B65D 5/48002 229/405 |
| 6,471,119 | B2 | 10/2002 | Cai | |
| 6,561,414 | B1 | 5/2003 | Cai | |
| 7,140,532 | B2 * | 11/2006 | Holt | B65D 81/3205 229/405 |
| 8,584,884 | B2 | 11/2013 | Learn et al. | |
| 8,955,738 | B2 * | 2/2015 | Cai | B65D 5/18 229/404 |
| 9,499,296 | B2 | 11/2016 | Mills et al. | |
| 9,809,373 | B2 | 11/2017 | Gallimore | |
| 9,957,080 | B2 | 5/2018 | Kastanek | |
| 10,329,049 | B2 | 6/2019 | Learn et al. | |
| 10,661,940 | B2 | 5/2020 | Hajek | |
| 11,059,621 | B2 | 7/2021 | Nowak et al. | |
| 11,198,536 | B2 | 12/2021 | Lombard et al. | |
| 11,440,697 | B2 | 9/2022 | Holley, Jr. | |
| 2006/0016863 | A1 | 1/2006 | Holt et al. | |
| 2012/0292382 | A1 | 11/2012 | Cai et al. | |
| 2013/0075392 | A1 | 3/2013 | Learn et al. | |
| 2017/0057689 | A1 | 3/2017 | Learn et al. | |
| 2022/0185539 | A1 * | 6/2022 | Barlow | B65D 5/48 |

OTHER PUBLICATIONS

U.S. Appl. No. 17/860,245, filed Apr. 29, 2024 Issue Fee Payment.
U.S. Appl. No. 17/860,245, filed Jan. 31, 2024 Notice of Allowance and Fees Due.
U.S. Appl. No. 17/860,245, filed Dec. 28, 2023 Amendment After Non-Final Action.
U.S. Appl. No. 17/860,245, filed Aug. 29, 2023 Non-Final Rejection.
U.S. Appl. No. 17/860,245, filed Aug. 22, 2023 Response to Restriction Requirement Filed.
U.S. Appl. No. 17/860,245, filed Jul. 5, 2023 Requirement for Restriction/Election.
International Search Report and Written Opinion mailed Dec. 28, 2022 in International Application No. PCT/US22/36443.

* cited by examiner

CONTAINER WITH INTEGRAL CONDIMENT POCKET

CROSS-REFERENCE TO RELATED APPLICATION

This application claims priority to U.S. Provisional Application Ser. No. 63/219,634 filed Jul. 8, 2021, and U.S. application Ser. No. 17/860,245 filed Jul. 8, 2022, the entire contents of which are hereby incorporated by reference in their entirety.

BACKGROUND

Field of the Disclosed Subject Matter

The present disclosed subject matter relates to a container for packaging and serving of food items, such as chicken nuggets, french fries, and other bite-size foods. Particularly, the present disclosed subject matter is directed to a container for holding food items, wherein the container has an integral pocket for holding items, such as condiments.

DESCRIPTION OF RELATED ART

A variety of food items, such as french fries, onion rings, chicken nuggets, popcorn shrimp, and other bite-size foods, are often served from small paperboard containers. These containers can be pouch-shaped, such as commonly used for french fries, or can be box-shaped and have a lid to contain the food item, such as deli items or the like. Exemplary containers for packaging and serving a variety of food items are provided in U.S. Pat. Nos. 10,329,049; 6,050,482; 6,053,403; 6,216,946; 6,561,414; and 8,584,884, each of which is incorporated by reference herein in its entirety.

Containers of this type can be formed of foldable paperboard, and can be a single-use product used in large quantities. As such, it can be desirable to reduce or minimize the costs associated with materials, manufacturing, storage, shipping, manner of use, and the like, of such containers.

It can also be desirable to provide a container with an integral pocket therein to hold items such as condiments. In this manner, each portion or compartment can contain a serving of a different product, with the different products separated by the divider.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a unitary blank for forming a container. The blank includes a base panel, a back body panel, a front body panel, a first side panel, a second side panel, and a pocket portion. The base panel has a base front edge and a base back edge. The back body panel extends from the base back edge to define a back base fold line therebetween. The back body panel has a back upper edge. The front body panel extending from the base front edge to define a front base fold line therebetween. The front body panel has a first front side edge, a second front side edge, and a front upper edge. The first side panel extends from the first front side edge to define a first front side fold line therebetween. The second side panel extends from the second front side edge to define a second front side fold line therebetween. The pocket portion extends from the front upper edge. The pocket portion includes a support panel, a pocket flap, a first side tab, and a second side tab. The support panel has a support top edge, a first support side edge, and a second side support edge. The pocket flap extends from the support top edge to define a pocket portion fold line therebetween. The first side tab extends from the first support side edge, and the first side tab is coupled to the first side panel. The second side tab extends from the second support side edge, and the second side tab is coupled to the second side panel. The first and second side panels are configured to be joined to the back body panel such that the front body panel, back body panel, first side panel, and second side panel define a container. The support panel of the pocket portion is configured to be separated from the front body panel along the front upper edge and joined to the back body panel such that the pocket portion and back body panel define a pocket therebetween.

As embodied herein, the first side panel can include a first side first portion, a first side second portion, and a first side third portion. The first side first portion can extend from the first front side fold line to a first side second portion fold line. The first side second portion can extend from the first side second portion fold line to a first side third portion fold line. The first side third portion can extend from the first side third portion fold line. The second side panel can include a second side first portion, a second side second portion, and second side third portion. The second side first portion can extend from the second front side fold line to a second side second portion fold line. The second side second portion can extend from the second side second portion fold line to a second side third portion fold line. The second side third portion can extend from the second side third portion fold line. The first side tab of the pocket portion can be joined to the first side second portion of the first side panel along the first side second portion fold line. The second side tab of the pocket portion can be joined to the second side second portion of the second side panel along the second side second portion fold line.

As embodied herein, the front upper edge can be cut along at least a length thereof. The front upper edge can be substantially arcuate in shape. The back upper edge can be substantially arcuate in shape and can have a concave notch defined therein. The pocket portion can have a pocket upper edge substantially arcuate in shape and can have a convex projection extending therefrom. The base panel can have a base fold line defined therein spaced from the base front edge and base back edge.

The disclosed subject matter also includes a container having a base panel, a back body panel, a front body panel, a first side panel, a second side panel, and a pocket portion. The base panel has a base front edge and a base back edge. The back body panel extends from the base back edge to define a back base fold line therebetween. The back body panel has a back upper edge. The front body panel extends from the base front edge to define a front base fold line therebetween. The front body panel has a first front side edge, a second front side edge, and a front upper edge. The first side panel is joined to the back body panel, and the first side panel extending from the first front side edge to define a first front side fold line therebetween. The second side panel is joined to the back body panel, and the second side panel extending from the second front side edge to define a second front side fold line therebetween. The pocket portion is joined to the back body panel. The pocket portion includes a support panel, a pocket flap, a first side tab, and a second side tab. The support panel has a support top edge, a first support side edge, and a second side support edge. The pocket flap extends from the support top edge to define a pocket portion fold line therebetween. The first side tab extends from the first support side edge, and the first side tab is coupled to the first side panel. The second side tab extends from the second support side edge, and the second side tab is coupled to the second side panel. The pocket portion and back body panel define a pocket therebetween. The pocket is moveable between a closed configuration and an open configuration by pivoting the pocket flap about the pocket portion fold line.

As embodied herein, the first side panel can include a first side first portion, a first side second portion, and a first side third portion. The first side first portion can extend from the first front side fold line to a first side second portion fold line. The first side second portion can extend from the first side second portion fold line to a first side third portion fold line. The first side third portion can extend from the first side third portion fold line. The second side panel can include a second side first portion, a second side second portion, and second side third portion. The second side first portion can extend from the second front side fold line to a second side second portion fold line. The second side second portion can extend from the second side second portion fold line to a second side third portion fold line. The second side third portion can extend from the second side third portion fold line. The first side tab of the pocket portion can be joined to the first side second portion of the first side panel. The second side tab of the pocket portion can be joined to the second side second portion of the second side panel.

The disclosed subject matter also includes a method of forming a container including providing a blank. The blank includes a base panel, a back body panel, a front body panel, a first side panel, a second side panel, and a pocket portion. The base panel has a base front edge and a base back edge. The back body panel extends from the base back edge to define a back base fold line therebetween. The back body panel has a back upper edge. The front body panel extending from the base front edge to define a front base fold line therebetween. The front body panel has a first front side edge, a second front side edge, and a front upper edge. The first side panel extends from the first front side edge to define a first front side fold line therebetween. The second side panel extends from the second front side edge to define a second front side fold line therebetween. The pocket portion extends from the front upper edge. The pocket portion includes a support panel, a pocket flap, a first side tab, and a second side tab. The support panel has a support top edge, a first support side edge, and a second side support edge. The pocket flap extends from the support top edge to define a pocket portion fold line therebetween. The first side tab extends from the first support side edge, and the first side tab is coupled to the first side panel. The second side tab extends from the second support side edge, and the second side tab is coupled to the second side panel. The method further includes joining the first and second side panels to the back body panel such that the front body panel, back body panel, first side panel, and second side panel define a container. The method further includes separating the support panel of the pocket portion from the front body panel and joining the support panel to the back body panel such that the pocket portion and back body panel define a pocket therebetween.

As embodied herein, the first side panel can include a first side first portion, a first side second portion, and a first side third portion. The first side first portion can extend from the first front side fold line to a first side second portion fold line. The first side second portion can extend from the first side second portion fold line to a first side third portion fold line. The first side third portion can extend from the first side third portion fold line. The second side panel can include a second side first portion, a second side second portion, and second side third portion. The second side first portion can extend from the second front side fold line to a second side second portion fold line. The second side second portion can extend from the second side second portion fold line to a second side third portion fold line. The second side third portion can extend from the second side third portion fold line. The method can further include joining the first side tab of the pocket portion to the first side second portion of the first side panel. The method can further include joining the second side tab of the pocket portion to the second side second portion of the second side panel.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DESCRIPTION OF THE DISCLOSED SUBJECT MATTER

Figure 1A:
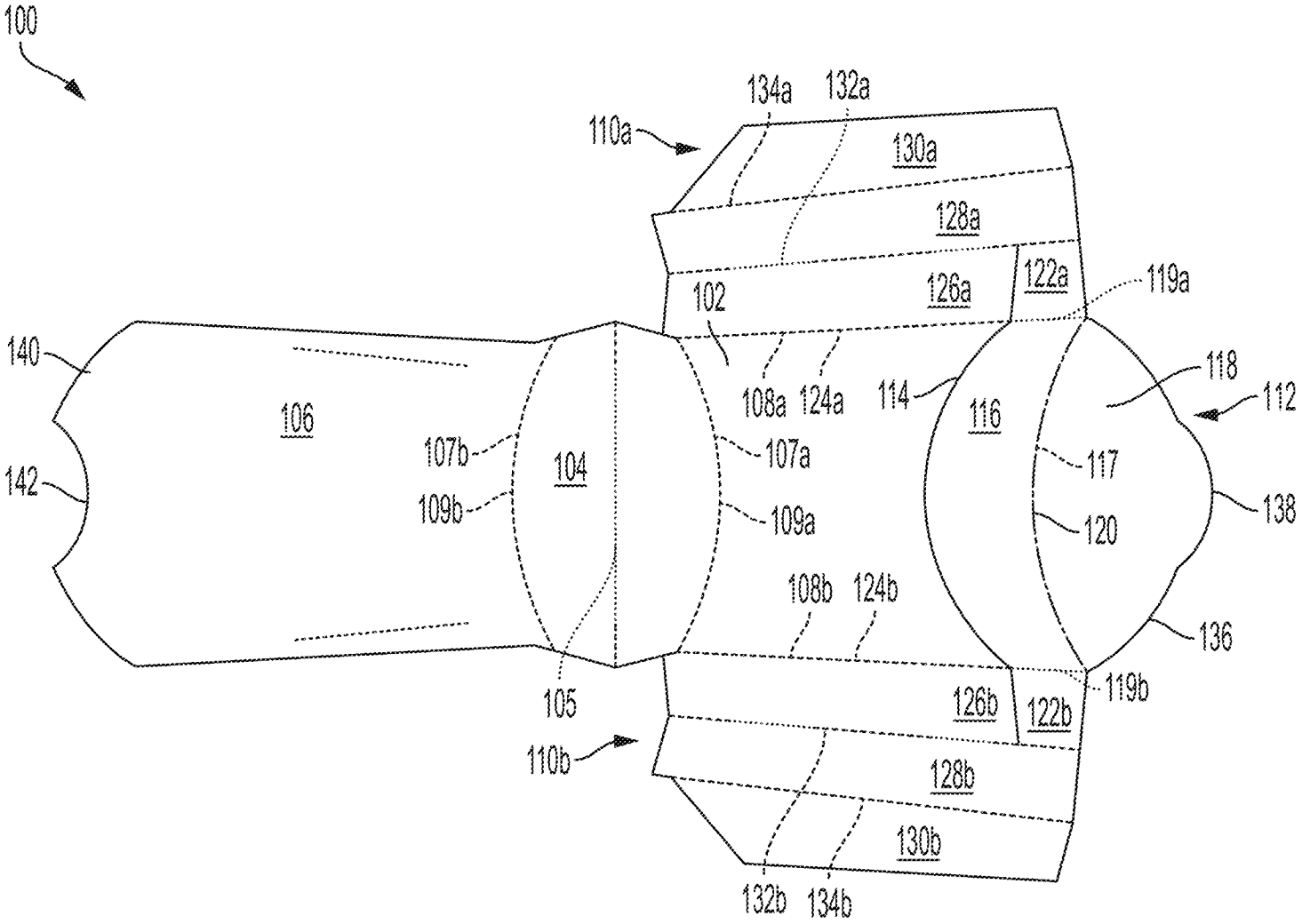
FIG. 1*a* is a plan view of a unitary blank for a container according to an aspect of the disclosed subject matter.

Reference will now be made in detail to the disclosed subject matter, examples of which are illustrated in the accompanying drawings. The structure and corresponding method of operation of the disclosed subject matter will be described in conjunction with the detailed description of the system.

The apparatus and methods presented herein may be used for transport of food items and other perishable and non-perishable products. The disclosed subject matter is particularly suited for packaging, serving, and storing of food items.

In accordance with the disclosed subject matter herein, the unitary blank for forming a container generally includes a base panel, a back body panel, a front body panel, a first side panel, a second side panel, and a pocket portion. The base panel has a base front edge and a base back edge. The back body panel extends from the base back edge to define a back base fold line therebetween. The back body panel has a back upper edge. The front body panel extends from the base front edge to define a front base fold line therebetween. The front body panel has a first front side edge, a second front side edge, and a front upper edge. The first side panel extends from the first front side edge to define a first front side fold line therebetween. The second side panel extends from the second front side edge to define a second front side fold line therebetween. The pocket portion extends from the front upper edge. The pocket portion includes a support panel, a pocket flap, a first side tab, and a second side tab. The support panel has a support top edge, a first support side edge, and a second side support edge. The pocket flap extends from the support top edge to define a pocket portion fold line therebetween. The first side tab extends from the first support side edge, and the first side tab is coupled to the first side panel. The second side tab extends from the second support side edge, and the second side tab is coupled to the second side panel. The first and second side panels are configured to be joined to the back body panel such that the front body panel, back body panel, first side panel, and second side panel define a container. The support panel of the pocket portion is configured to be separated from the front body panel along the front upper edge and joined to the back body panel such that the pocket portion and back body panel define a pocket therebetween. A container having a base panel, front and back body panels, first and second side panels, and a pocket portion is also provided. A method for forming a container is also provided.

The accompanying figures, where like reference numerals refer to identical or functionally similar elements throughout the separate views, serve to further illustrate the disclosed subject matter and to explain various principles and advantages all in accordance with the disclosed subject matter. For purpose of explanation and illustration, and not limitation, the disclosed subject matter is shown in FIGS. 1*a*-2*b*. The container is suitable for use with a wide variety of hot and cold food items, such as fruit slices, chips, bread sticks, candies, and other suitable bite-size food items, particularly if typically consumed with a dipping sauce or the like. The container disclosed herein is particularly suitable and beneficial for use with hot, prepared food items, such as chicken nuggets, french fries, onion rings, and popcorn shrimp, wherein the container can be used for transporting such food items as well as serving of different type of products (e.g., french fries with condiments) each in separate portions or compartments in the container.

For purpose of illustration, and not limitation, reference will made herein to a container intended to contain food items. Additionally, as used herein, the terms "front," "back," "side," "upper," "top," and "base" are used for the purpose of illustration only, and not limitation. That is, it is recognized that the terms "front," "back," "side," "upper," "top," and "base" are merely used herein as a point of reference.

Figure 1B:
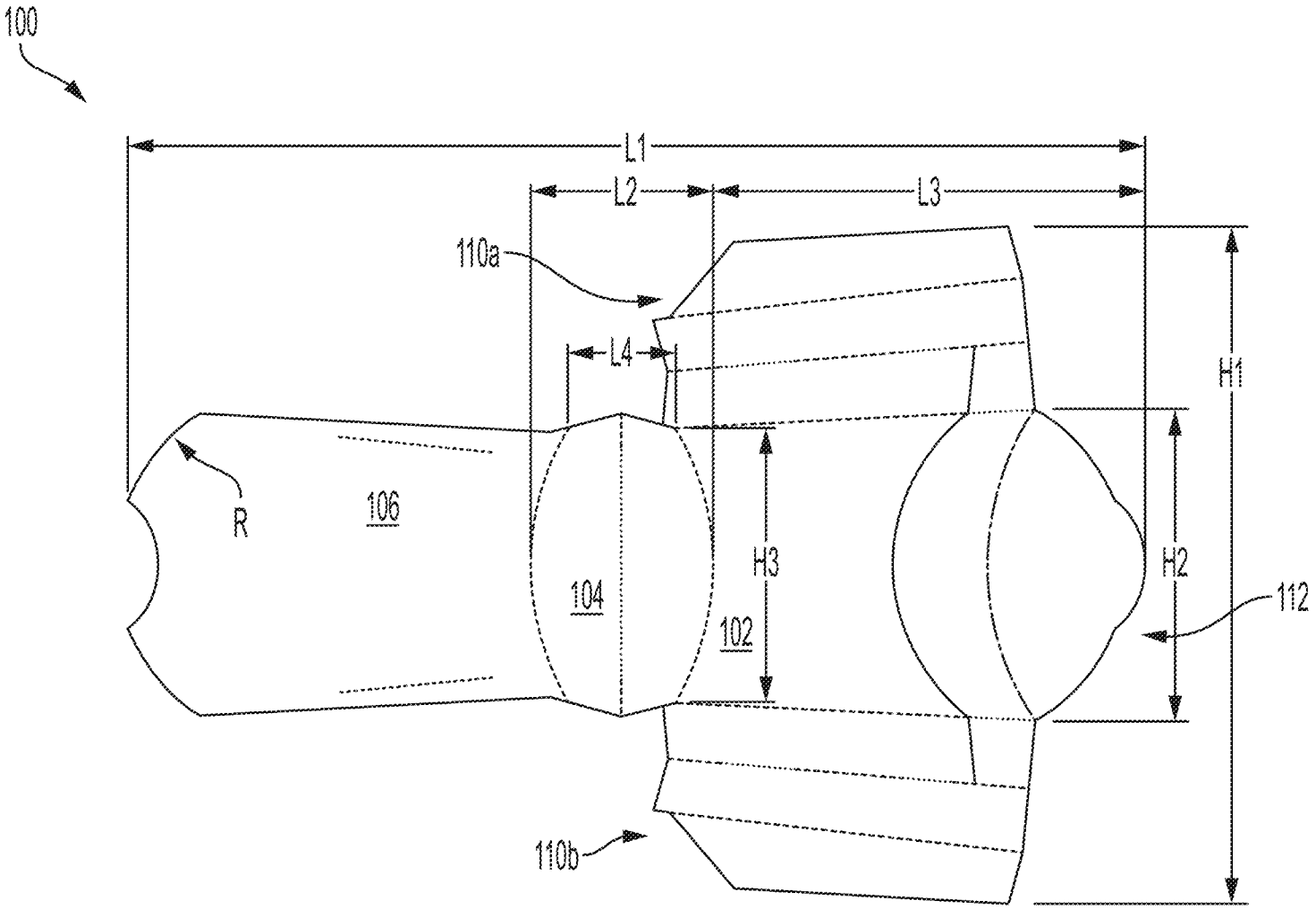
FIG. 1*b* is another plan view of the unitary blank for a container of FIG. 1*a*.

For purpose of illustration and not limitation, reference is made to a unitary blank 100 for a container shown in FIGS. 1*a* and 1*b*. Additionally, for purpose of understanding, reference is made in conjunction to the container 200 of FIGS. 2*a* and 2*b* formed by the blank 100 of FIGS. 1*a* and 1*b*.

Figure 2A:
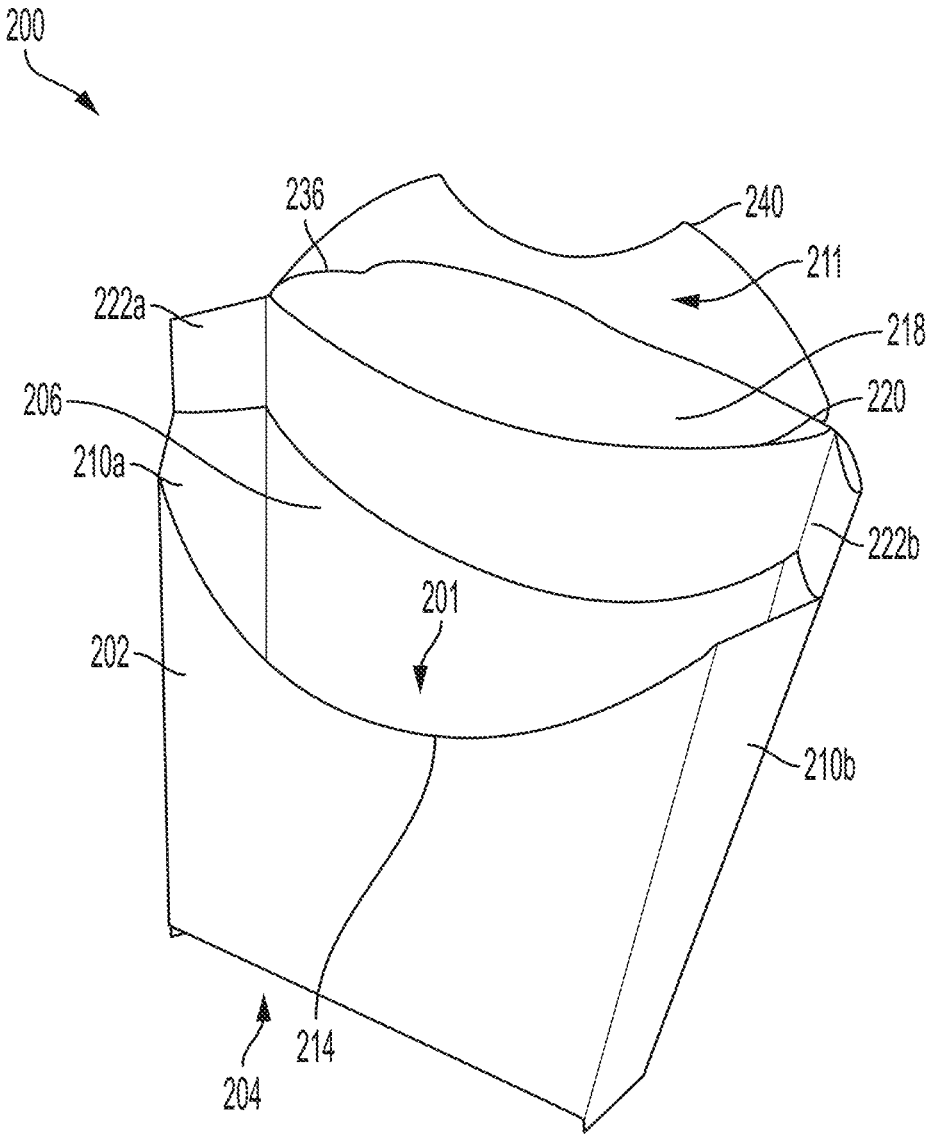
FIG. 2*a* is a right perspective view of a container formed from the unitary blank of FIG. 1*a*.
Figure 2B:
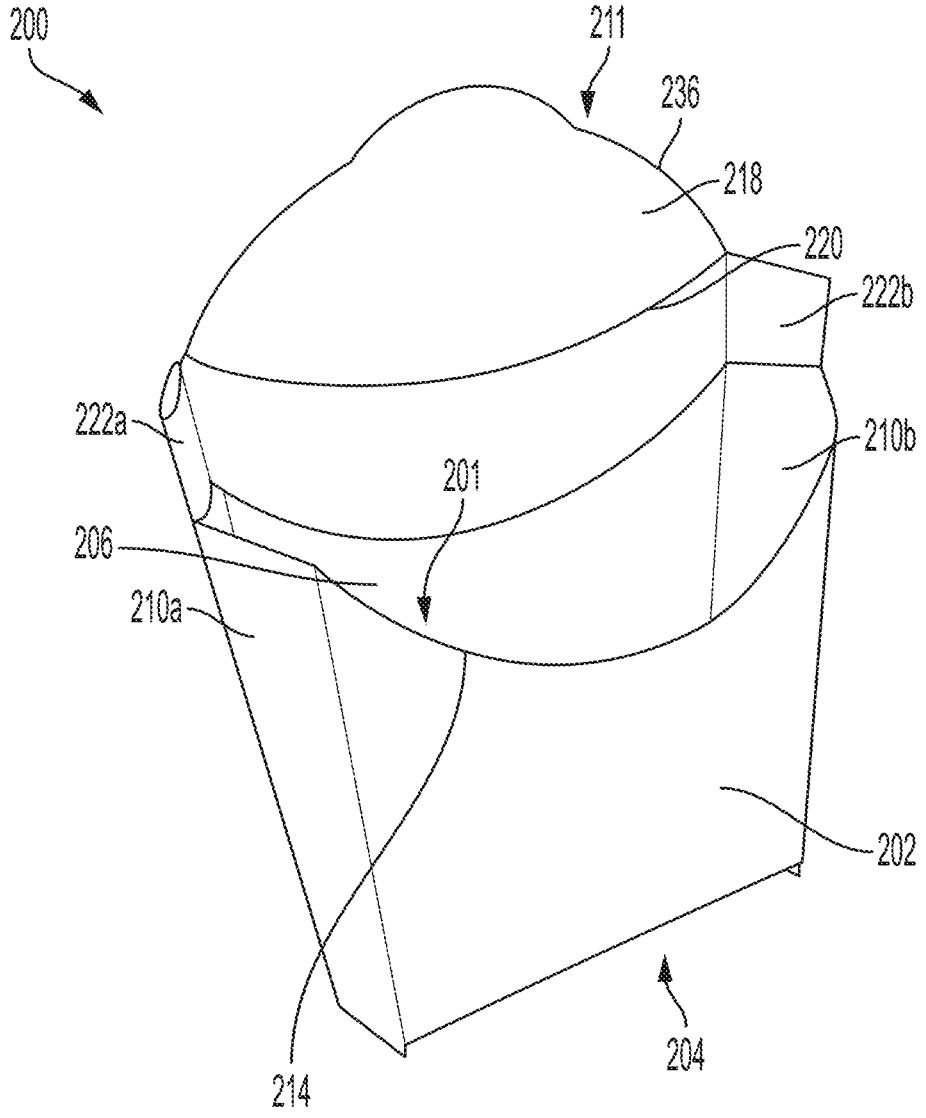
FIG. 2*b* is a left perspective view of the container formed from the unitary blank of FIG. 1*a*.

As shown in FIG. 1*a*, the blank 100 generally includes a base panel 104, a front body panel 102, a back body panel 106, a first side panel 110*a*, a second side panel 110*b*, and a pocket portion 112. The base panel 104 has a base front edge 107*a* and a base back edge 107*b*. The back body panel 106 extends from the base back edge 107*b* to define a back base fold line 109*b* therebetween and along the base back edge 107*b*. The back body panel 106 has a back upper edge 140. The front body panel 102 extends from the base front edge 107*a* to define a front base fold line 109*a* therebetween and along the base front edge 107*a*. The front body panel 102 has a first front side edge 108*a*, a second front side edge 108*b*, and a front upper edge 114. The first side panel 110*a* extends from the first front side edge 108*a* to define a first front side fold line 124*a* therebetween. The second side panel 110*b* extends from the second front side edge 108*b* to define a second front side fold line 124*b* therebetween. The pocket portion 112 extends from the front upper edge 114. The pocket portion 112 includes a support panel 116, a pocket flap 118, a first side tab 122*a*, and a second side tab 122*b*. The support panel 116 has a support top edge 117, a first support side edge 119*a*, and a second side support edge 119*b*. The pocket flap 118 extends from the support top edge 117 to define a pocket portion fold line 120 therebetween. The first side tab 122*a* extends from the first support side edge 119*a*. The first side tab 122*a* is coupled to the first side panel 110*a*. The second side tab 122*b* extends from the second support side edge 119*b*. The second side tab 122*b* is coupled to the second side panel 110*b*. The first and second side panels 110*a*, 110*b* are configured to be joined to the back body panel 106 such that the front body panel 102, back body panel 106, first side panel 110*a*, and second side panel 110*b* define a container 200, as shown in FIGS. 2*a* and 2*b*. The support panel 116 of the pocket portion 112 is configured to be separated from the front body panel 102 along the front upper edge 114 and joined to the back body panel 106 such that the pocket portion 112 and back body panel 106 define a pocket 211 therebetween, as shown in FIGS. 2*a* and 2*b*. Although front and back body panels 102, 106 are illustrated, any suitable number of body portions can be used.

With reference to the blank 100 of FIG. 1*a*, the first side panel 110*a* can include a first side first portion 126*a*, a first side second portion 128*a*, and a first side third portion 130*a*. The first side first portion 126*a* can extend from the first front side fold line 124*a* to a first side second portion fold line 132*a*. The first side second portion 128*a* can extend from the first side second portion fold line 132*a* to a first side third portion fold line 134*a*. The first side third portion 130*a* can extend from the first side third portion fold line 134*a*. The second side panel 110*b* can include a second side first portion 126*b*, a second side second portion 128*b*, and second side third portion 130*b*. The second side first portion 126*b* can extend from the second front side fold line 124*b* to a second side second portion fold line 132*b*. The second side second portion 128*b* can extend from the second side second portion 132*b* fold line to a second side third portion fold line 134*b*. The second side third portion 130*b* can extend from the second side third portion fold line 134*b*. The first side tab 122*a* of the pocket portion 112 can be joined to the first side second portion 128*a* of the first side panel 110*a* along the first side second portion fold line 132*a*. The second side tab 122*b* of the pocket portion 112 can be joined to the second side second portion 128*b* of the second side panel 110*b* along the second side second portion fold line 132*b*. Side panels 110*a*, 110*b* and portions 126*a*, 126*b*, 128*a*, 128*b*, 130*a*, 130*b* can be of any suitable shape and dimension. Although side panels 110*a*, 110*b* and portions 126*a*, 126*b*, 128*a*, 128*b*, 130*a*, 130*b* are illustrated, any suitable number of side panels and portions can be used.

For purpose of illustration and not limitation, and as embodied herein, the front upper edge 114 of front body panel 102 can have any suitable shape and dimension, including but not limited to substantially arcuate in shape. The upper edge 114 can be die-cut during manufacture along at least a length thereof. The back upper edge 140 of back body panel 106 can have any suitable shape and dimension, including but not limited to substantially arcuate in shape.

The back upper edge 140 can have a concave notch 142 defined therein. The notch 142 can have any suitable shape and dimension, including but not limited to "c"-shaped or arcuate, radius corners, or angled straight edges. The pocket portion 112 can have a pocket upper edge 136, and the pocket upper edge 136 can have any suitable shape and dimension, including but not limited to substantially arcuate in shape. The pocket upper edge 136 can have a convex projection 138 extending therefrom. The projection 138 can be of any suitable shape and dimension, including but not limited to "c"-shaped or arcuate, radius corners, or angled straight edges. Additionally or alternatively, the convex projection 138 can be the convex mirror image of the concave notch 142. The support top edge 117 and pocket portion fold line 120 of support panel 116 can have any suitable shape and dimension, including but not limited to substantially arcuate in shape.

For purpose of illustration and not limitation, and as embodied herein, the base panel 104 of blank 100 can have a base fold line 105 defined therein spaced from the base front edge 107*a* and the base back edge 107*b*. The base front edge 107*a* and the base back edge 107*b* can have any suitable shape and dimension, including but not limited to curved, straight, or substantially arcuate in shape.

It is to be recognized that the dimensions and relative proportions of the front body panels 102, 202, back body panels 106, 206, etc., of the blank 100 or container 200 will vary according to the exact size and intended use of the blank 100 or container 200. For purpose of illustration and not limitation, with reference to the blank 100 of FIG. 1*b*, the blank can have a length L1 of about 10.0 to 14.0 inches, a length L2 of about 1.5 to 3.0 inches, a length L3 of about 5.0 to 6.5 inches, a length L4 of about 1.0 to 2.5 inches. The blank can have a width H1 of about 8.0 to 9.5 inches, a width H2 of about 3.5 to 5.0 inches, a width H3 of about 3.0 to 4.0 inches. The blank can have radius R of about 2.0 to 3.0 degrees. Although particular dimensions are described, any suitable dimensions can be used. It will be apparent to those skilled in the art that various modifications and variations to the exemplary dimensions and angles can be made without departing from the spirit or scope of the disclosed subject matter. One of ordinary skill will recognize that any suitable shape and depth of the container and corresponding blank can be employed, and the disclosed subject matter is not limited to the sizes and shapes illustrated in FIGS. 1*a*-2*b*. Other suitable shapes include rectangles, triangles, cylinders, ovals, various polygons, etc., having any suitable dimensions.

With reference to the blank 100 of FIG. 1*a*, as embodied herein, container 200 can be formed from blank 100 by folding the back body panel 106 along the base fold line 105 to extend parallel to the front body panel 102, and folding the first and second side panels 110*a*, 110*b* away from the front body panel 102 to join to the back body panel 106. For purpose of illustration and not limitation, the first side third portion 130*a* of the first side panel 110*a* can be joined to the back body panel 106, and the second side third portion 130*b* of the second side panels 110*b* can be joined to the back body panel 106. The front body panel 102, back body panel 106, first side panel 110*a*, and second side panel 110*b* can define container 200. The container 200 can have an interior 201, front and back body panels 202, 206, first and second side panels 210*a*, 210*b*, and base 204, as shown in FIGS. 2*a* and 2*b*. The first and second side panels 110*a*, 110*b* can be joined to the back body panel 106 using conventional techniques, such as by glue or thermal adhesive or the like. The first and second side third portions 130*a*, 130*b* can be joined to the back body panel 106 using conventional techniques, such as by glue or thermal adhesive or the like. Although particular features are described, the container 200 can have one or more of the features as included in blank 100.

Additionally, and with reference to FIG. 1*a*, the support panel 116 of the pocket portion 112 can be separated from the front body panel 102 and joined to the back body panel 106 to define pocket 211 of container 200 therebetween having a pocket flap 218, as shown in FIGS. 2*a* and 2*b*. The support panel 116 can be joined to the back body panel 106 using conventional techniques, such as by glue or thermal adhesive or the like. The pocket 211 can have a pocket flap 218. When support panel 116 is joined to the back body panel 106, the first side tab 122*a* can be joined to the first side second portion 128*a* of the first side panel 110*a* to form first side tab 222*a* of container 200, and the second side tab 122*b* can be joined to the second side second portion 128*b* of the second side panel 110*b* to form second side tab 222*b* of container 200. The first and second side tabs 122*a*, 122*b* can be joined to the first and second side second portions 128*a*, 128*b* free of adhesive, or using conventional techniques, such as by glue or thermal adhesive or the like.

For purpose of illustration and not limitation, and as embodied herein, the pocket 211 of container 200 can be moveable between an open position and a closed position by pivoting the pocket flap 218 about a pocket portion fold line 220. The pocket 211 can have a closed configuration (as shown, for example, in FIG. 2*b*) when the pocket flap 218 is parallel to the back body panel 206. The pocket 211 can have an open configuration (as shown, for example, in FIG. 2*a*) when the pocket flap 218 extends towards the interior 201 of the container 200. For example, for purpose of illustration and not limitation, the pocket flap 218 can be folded about pocket portion fold line 220, or the pocket flap 218 can fold about pocket portion fold line 220 when an exterior pressure is applied to the tabs 222*a*, 222*b* or side panels 210*a*, 210*b*.

The container 200 can have one or more of the features as included in blank 100. For example, the container 200 can include upper edges 214, 236, 240. The upper edges 214, 236, 240 can be of any suitable shape and dimension, including the shapes and dimensions of upper edges 114, 136, 140 of blank 100.

The containers disclosed herein are preferably disposable, but it is contemplated that they may be reused at a future time. Also, the containers can be constructed from materials suitable to be placed in a heating apparatus, such as a microwave, to heat the food and/or used for storage in the refrigerator or freezer. Additionally, the materials from which the containers are made need not be the same throughout. The containers and blanks described herein can be manufactured from any suitable material, including but not limited to paperboard.

In addition to the disclosed subject matter claimed below, the disclosed subject matter is also directed to other aspects of the disclosed subject matter having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other aspects of the disclosed subject matter having any other possible combinations. Thus, the foregoing description of the disclosed subject matter has been presented for purposes of illustration and description. It is not intended to be exhaustive or to limit the disclosed subject matter to the aspects of the disclosed subject matter disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A unitary blank for forming a container comprising:

a base panel having a base front edge and a base back edge;

a back body panel extending from the base back edge to define a back base fold line therebetween, the back body panel having a back upper edge, the back upper edge having a concave notch defined therein;

a front body panel extending from the base front edge to define a front base fold line therebetween, the front body panel having a first front side edge, a second front side edge, and a front upper edge;

a first side panel extending from the first front side edge to define a first front side fold line therebetween;

a second side panel extending from the second front side edge to define a second front side fold line therebetween; and a pocket portion extending from the front upper edge, the pocket portion comprising:

a support panel having a support top edge, a first support side edge coupled to the first side panel, and a second side support edge coupled to the second side panel; and a pocket flap extending from the support top edge to define a pocket portion fold line therebetween, the pocket flap having a pocket upper edge with a convex projection extending therefrom, the convex projection having a shape being a mirror image of the concave notch;

wherein the first and second side panels are configured to be joined to the back body panel such that the front body panel, back body panel, first side panel, and second side panel define a container, and further wherein the support panel of the pocket portion is configured to be separated from the front body panel along the front upper edge and joined to the back body panel such that the pocket portion and back body panel define a pocket therebetween.

2. The blank of claim 1, wherein the first side panel comprises a first side first portion, a first side second portion, and a first side third portion, the first side first portion extending from the first front side fold line to a first side second portion fold line, the first side second portion extending from the first side second portion fold line to a first side third portion fold line, the first side third portion extending from the first side third portion fold line; and wherein the second side panel comprises a second side first portion, a second side second portion, and second side third portion, the second side first portion extending from the second front side fold line to a second side second portion fold line, the second side second portion extending from the second side second portion fold line to a second side third portion fold line, the second side third portion extending from the second side third portion fold line.

3. The blank of claim 1, wherein the front upper edge is substantially arcuate in shape.

4. The blank of claim 1, wherein the back upper edge is substantially arcuate in shape.

5. The blank of claim 1, wherein the pocket upper edge is substantially arcuate in shape.

6. The blank of claim 1, wherein the base panel has a base fold line defined therein spaced from the base front edge and base back edge.

7. The blank of claim 1, wherein the pocket portion fold line is arcuate.

8. The blank of claim 1, further comprising a first side tab extending from the first support side edge to couple the first support side edge to the first side panel, and a second side tab extending from the second support side edge to couple the second support side edge to the second side panel.

9. The blank of claim 8, wherein the first side tab of the pocket portion is coupled to the first side second portion of the first side panel along the first side second portion fold line, and the second side tab of the pocket portion is coupled to the second side second portion of the second side panel along the second side second portion fold line.

10. A container comprising:

a base panel having a base front edge and a base back edge;

a back body panel extending from the base back edge to define a back base fold line therebetween, the back body panel having a back upper edge, the back upper edge having a concave notch defined therein;

a front body panel extending from the base front edge to define a front base fold line therebetween, the front body panel having a first front side edge, a second front side edge, and a front upper edge;

a first side panel joined to the back body panel, the first side panel extending from the first front side edge to define a first front side fold line therebetween;

a second side panel joined to the back body panel, the second side panel extending from the second front side edge to define a second front side fold line therebetween; and a pocket portion joined to the back body panel, the pocket portion comprising:

a support panel having a support top edge, a first support side edge coupled to the first side panel, and a second side support edge coupled to the second side panel; and a pocket flap extending from the support top edge to define a pocket portion fold line therebetween, the pocket flap having a pocket upper edge with a convex projection extending therefrom, the convex projection having a shape being a mirror image of the concave notch;

wherein the pocket portion and back body panel define a pocket therebetween;

wherein the pocket is moveable between a closed configuration and an open configuration by pivoting the pocket flap about the pocket portion fold line.

11. The container of claim 10, wherein the first side panel comprises a first side first portion, a first side second portion, and a first side third portion, the first side first portion extending from the first front side fold line to a first side second portion fold line, the first side second portion extending from the first side second portion fold line to a first side third portion fold line, the first side third portion extending from the first side third portion fold line; and wherein the second side panel comprises a second side first portion, a second side second portion, and second side third portion, the second side first portion extending from the second front side fold line to a second side second portion fold line, the second side second portion extending from the second side second portion fold line to a second side third portion fold line, the second side third portion extending from the second side third portion fold line.

12. The container of claim 10, wherein the pocket portion fold line is arcuate.

13. The container of claim 10, further comprising a first side tab extending from the first support side edge to couple the first support side edge to the first side panel, and a second side tab extending from the second support side edge to couple the second support side edge to the second side panel.

14. The container of claim 13, wherein the first side tab of the pocket portion is coupled to the first side second portion of the first side panel, and the second side tab of the pocket portion is coupled to the second side second portion of the second side panel.

15. A method of forming a container comprising:

providing a blank comprising:

a base panel having a base front edge and a base back edge;

a back body panel extending from the base back edge to define a back base fold line therebetween, the back body panel having a back upper edge, the back upper edge having a concave notch defined therein;

a front body panel extending from the base front edge to define a front base fold line therebetween, the front body panel having a first front side edge, a second front side edge, and a front upper edge;

a first side panel extending from the first front side edge to define a first front side fold line therebetween;

a second side panel extending from the second front side edge to define a second front side fold line therebetween; and a pocket portion extending from the front upper edge, the pocket portion comprising:

a support panel having a support top edge, a first support side edge coupled to the first side panel, and a second side support edge coupled to the second side panel; and a pocket flap extending from the support top edge to define a pocket portion fold line therebetween, the pocket flap having a pocket upper edge with a convex projection extending therefrom, the convex projection having a shape being a mirror image of the concave notch;

joining the first and second side panels to the back body panel such that the front body panel, back body panel, first side panel, and second side panel define a container; and separating the support panel of the pocket portion from the front body panel and joining the support panel to the back body panel such that the pocket portion and back body panel define a pocket therebetween.

16. The method of claim 15, wherein the first side panel comprises a first side first portion, a first side second portion, and a first side third portion, the first side first portion extending from the first front side fold line to a first side second portion fold line, the first side second portion extending from the first side second portion fold line to a first side third portion fold line, the first side third portion extending from the first side third portion fold line; and wherein the second side panel comprises a second side first portion, a second side second portion, and second side third portion, the second side first portion extending from the second front side fold line to a second side second portion fold line, the second side second portion extending from the second side second portion fold line to a second side third portion fold line, the second side third portion extending from the second side third portion fold line.

17. The method of claim 15, wherein the pocket portion fold line is arcuate.

18. The method of claim 15, wherein the blank further comprises a first side tab extending from the first support side edge to couple the first support side edge to the first side panel, and a second side tab extending from the second support side edge to couple the second support side edge to the second side panel.

* * * * *